US009270028B2

(12) United States Patent
Ruvinsky et al.

(10) Patent No.: US 9,270,028 B2
(45) Date of Patent: Feb. 23, 2016

(54) MULTI-ARM CONFORMAL SLOT ANTENNA

(75) Inventors: Leonard Ruvinsky, Merrimack, NH (US); Zane Lo, Merrimack, NH (US); Mark W. Reed, Manchester, NH (US); Patrick McKivergan, Londonderry, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 188 days.

(21) Appl. No.: 13/595,470

(22) Filed: Aug. 27, 2012

(65) Prior Publication Data

US 2013/0063321 A1 Mar. 14, 2013

Related U.S. Application Data

(60) Provisional application No. 61/527,760, filed on Aug. 26, 2011.

(51) Int. Cl.

| | |
|---|---|
| ***H01Q 13/18*** | (2006.01) |
| ***H01Q 5/02*** | (2006.01) |
| ***H01Q 5/371*** | (2015.01) |

(52) U.S. Cl.

CPC ..... *H01Q 13/18* (2013.01); *H01Q 5/371* (2013.01)

(58) Field of Classification Search

CPC ..... H01Q 11/10; H01Q 13/10; H01Q 21/005; H01Q 5/02; H01Q 13/18

USPC ..... 343/767, 770, 771, 792.5, 793, 795, 343/807, 812, 813

See application file for complete search history.

(56) References Cited

U.S. PATENT DOCUMENTS

| | | | | |
|---|---|---|---|---|
| 3,369,243 | A * | 2/1968 | Greiser | 343/770 |
| 3,971,032 | A * | 7/1976 | Munson et al. | 343/770 |
| 4,594,595 | A * | 6/1986 | Struckman | 343/770 |
| 4,746,867 | A * | 5/1988 | Gunton | 324/329 |
| 7,268,736 | B1 * | 9/2007 | Tikhov et al. | 343/770 |
| 2007/0080878 | A1 * | 4/2007 | McLean | 343/725 |
| 2007/0176838 | A1 * | 8/2007 | Zink et al. | 343/797 |
| 2007/0182655 | A1 * | 8/2007 | Lee et al. | 343/792.5 |
| 2008/0007471 | A1 * | 1/2008 | Goldberg et al. | 343/705 |
| 2009/0207092 | A1 * | 8/2009 | Nysen et al. | 343/876 |

* cited by examiner

*Primary Examiner* — Robert Karacsony
*Assistant Examiner* — Daniel J Munoz
(74) *Attorney, Agent, or Firm* — Daniel J. Long

(57) ABSTRACT

An octave bandwidth conformal cavity-backed slot antenna includes a ground plane with a number of different length slits that come together at the central feedpoint. The slit length varies from one-half a wavelength at the highest frequency at which the antenna is to operate for the short side to one wavelength at the highest frequency for the long side, with the proximal ends of the slits having a common feedpoint. Such slot antennas may be arrayed in a quad configuration. Because the trapezoidal envelope of the antenna induces the phase-center to shift with frequency, when two are arrayed with short sides adjacent, the spacing between them results in a phase center from one antenna to the next that is effectively within half a wavelength at all frequencies.

21 Claims, 12 Drawing Sheets

MULTI-ARM CONFORMAL SLOT ANTENNA

RELATED APPLICATIONS

This Application claims rights under 35 USC §119 (e) from U.S. Provisional Application Ser. No. 61/527,760 filed Aug. 26, 2011, the contents of which are incorporate herein by reference.

STATEMENT OF GOVERNMENT INTEREST

The invention claimed in this patent application was made with U.S. Government support under contract no. F33657-91-C-0006 awarded by the Aeronautical Systems Center. The U.S. Government has certain rights in the invention.

FIELD OF THE INVENTION

The present invention relates to conformal antennas, slot antennas, antenna arrays, and more specifically to a quad-array of multi-arm slot antennas.

BACKGROUND OF THE INVENTION

Aircraft and other vehicles are commonly provided with cavity-backed slot antennas which in general involve a slot through a ground plane. These cavity-backed slot antennas are by their very nature narrow banded and it is only with difficulty that one can increase the bandwidth of the slot antenna so that it may be used over a wide frequency range for detection of multiple transmitters. Wide bandwidth slots support, for instance, direction finding involving angle of arrivals (AOA) determinations, and radar-warning systems. Unlike horn and spiral antennas, slots can be spaced within a half wavelength to allow unambiguous phase determination, beamforming and sidelobe control.

Moreover, it is desirable to provide an S band or an L band conformal slot antenna for high power communications. In general slots may be scaled dimensionally to support systems of various mission needs. Combining ultra-wide bandwidth with the scalability and phase control of slot arrays allows them to be used with the most demanding radar and communications signal receiving electronic-warfare receivers and transmitters.

The slot is cut or etched into a metallic ground plane, which may be shaped to conform to the smoothly curving surface of an aircraft or other platform, thus being described as conformal.

In the past one way to obtain greater bandwidth was to attempt to increase the width of the slot. However, the result is a wide open wave guide cavity. The problem with such a wide slot is an intolerable radar cross section that would cause a stealthy platform to be susceptible to illumination by enemy radars.

Another application that was attempted was to create an array of four slots in a square arrangement so that the resulting antenna would not only have a broader bandwidth, but also would behave like a monopole extending out of the surface of the ground plane. If the four slots were fed together in phase, while one would achieve a monopole behavior, the bandwidth would nonetheless be limited by the bandwidth associated with the slots. Other feed arrangements for the square array allow diversity of polarization or direction finding. However, these also would be of limited application if the slot bandwidth could not be extended.

The challenge was to come up with a way to make a fat slot but with the fat slot mostly covered up so as not to present a large structural radar cross section. Moreover, there needed to be a way to fit the slots in a square array without the wide fat slots overlapping.

In short, a topology needed to be developed that would provide a 2:1 or 3:1 bandwidth without significantly increasing the platform's radar cross section and to do so with conformal antenna apertures usable on the skin of aircraft or other vehicles.

In summary, there is a conflict between close spacing and minimum length and width for slot antennas in a quad array. Close half-wavelength spacing or less is required element-to-element at highest frequencies (i.e., short wavelengths), but the length of elements must be half-wavelength at low frequencies (long wavelengths) for efficient performance. Also, each element must be wide enough to achieve bandwidth. Additionally, the radar cross section of the conformal aperture must be minimized. A need therefore exists for wide instantaneous bandwidth (3:1) conformal slot apertures capable of handling high power and of being arrayed in a quad configuration for 360 degree azimuthal coverage.

SUMMARY OF INVENTION

According to the present invention, a wide bandwidth conformal cavity-backed slot antenna is comprised of multiple arms in the form of slits that connect at a feedpoint to form a multi-armed slot that behaves as a single slot antenna. In one embodiment each multi-arm slot antenna includes two opposed multi-slit back-to-back pitchforked shapes, with each pitchfork having at least three slits of decreasing length, with the proximal ends of the slits connected at a feedpoint. The ends of the slits define a trapezoidal envelope due to their decreasing lengths across the width of the antenna. The slits loosely resemble either a spider or pitchfork tines that extend from a lateral support.

It has been found that the width of the pitchfork antenna from short slit to long slit must be no greater than $\lambda/4$ at the highest frequency for which the antenna is designed. If this width is over $\lambda/4$ then the performance is severely degraded to point of inoperability. Moreover, for a 2:1 bandwidth the overall length of the shortest slits is $\lambda/2$ for the highest frequency, whereas the overall length of the longest slits are one wavelength at the highest frequency. Thus the ratio of the lengths of the short side to the long side is 2:1.

In summary, the pitchfork embodiment the slits or arms increase in length from one side of the antenna element to the other, with the overall length of the longest slits corresponding to one wavelength at the highest frequency at which the antenna is to operate, and with the overall length of the shortest slits corresponding to one-half wavelength at the highest frequency. The multi-arm slot is designed to have a phase center that moves toward the shortest arms with increasing frequency. Without loading, this multi-arm slot configuration achieves a 2:1 bandwidth.

According to an improved embodiment of the multi-arm slot antenna, the distal ends of the slits are loaded in order to prevent higher level modes and the slits are tapered wider toward the distal ends. Further, a balun feed structure is added within the cavity to match or offset reactive impedances inherent to the slot. This combination of enhancements enables extension of the RF bandwidth to 3:1.

To establish monopole-like performance, four multi-arm slot antennas are arrayed at 90 degrees relative to each other in a square to form a quad-slot array. This square arrangement, made possible due to the trapezoidal envelope of the antenna elements, may be altered into a rhombus to reduce the tendency of the square array to reflect higher-frequency incoming radar signals back to their source. The trapezoidal envelope of the array element slit-lengths may be canted to better fit into the rhombus array configuration to align with platform edges of an aircraft.

In summary, an octave bandwidth conformal cavity-backed slot antenna includes a ground plane with a number of different length slits that come together at the central feedpoint. The slit length varies from one-half a wavelength at the highest frequency at which the antenna is to operate for the short side to one wavelength at the highest frequency for the long side, with the proximal ends of the slits having a common feedpoint. Such slot antennas may be arrayed in a quad configuration. Because the trapezoidal envelope of the antenna induces the phase-center to shift with frequency, when two are arrayed with short sides adjacent, the spacing between them results in a phase center from one antenna to the next that is effectively within half a wavelength at all frequencies. Furthermore, also due to the trapezoidal envelope, four multi-arm slots may be arrayed in a square configuration without exceeding the half-wavelength array spacing requirement for the phase centers. Extended low frequency bandwidth is provided by either magnetically or resistively loading the distal ends of selected slits and the use of an ultra-wideband balun.

BRIEF DESCRIPTION OF THE DRAWINGS

These and other features of the subject invention will be better understood in connection with the Detailed Description, in conjunction with the Drawings, of which.

DETAILED DESCRIPTION

A multi-arm slot implementation is disclosed that can achieve wide instantaneous bandwidth 3:1 using conformal antenna apertures. These conformed multi-arm antenna are capable of handling high power and of being arrayed in a quad configuration for 360 degree azimuthal coverage. This coverage can support Electronic Warfare, Direction Finding (DF), Communications and other applications. The conformal surface is particularly useful for airborne and other mobile platforms. According to one embodiment, the multi-arm slot may result in high effective radiated power in a transmit configuration and increased electronic surveillance measurement sensitivity, while being compatible with low-complexity arctangent DF implementations. In other embodiments, the slots may be arrayed for increased gain, beam-forming and side-lobe control.

According to one embodiment, the array uses multiple narrow slits fed in parallel to broaden bandwidth relative to a single narrowband slot design. The multi-arm geometry is chosen such that the radiating portion of the antenna is close to half-wavelength for efficient operation, maintaining a nominal cosine radiation pattern. Narrow slits minimize structural scattering of incident radar signals. Each multi-arm slot in a quad array may optionally have its own cavity-backing thus allowing greater structural support.

Figure 1:
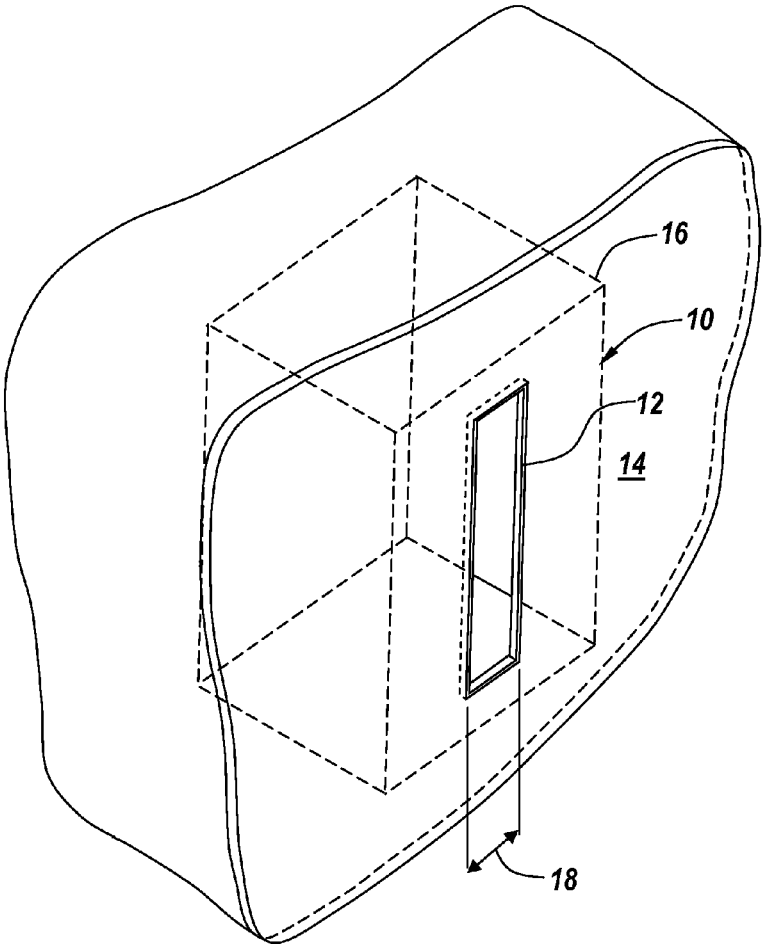
Fig. 1 (Prior Art)
FIG. 1 is a diagrammatic illustration of a prior art cavity packed conformal slot antenna.

Referring now to FIG. 1, the prior art a typical cavity backed slot antenna 10 includes a slot 12 through the surface 14 of for instance the skin of an aircraft. It is noted that a cavity shown in dotted outline 16 is placed in back of the slot for containing radiation that is projected into the aircraft or behind the skin of the vehicle and controlling the slot's electrical parameter of input impedance. It will be appreciated that the slot antenna shown in FIG. 1 is a narrow band antenna. The bandwidth is proportional to the width of the slot shown by double ended arrow 18. As mentioned hereinbefore, while the slot may be fattened, the problem for some platforms is intolerable radar cross section which exposes a low-observable aircraft or other vehicle to detection by enemy radar.

Figure 2:
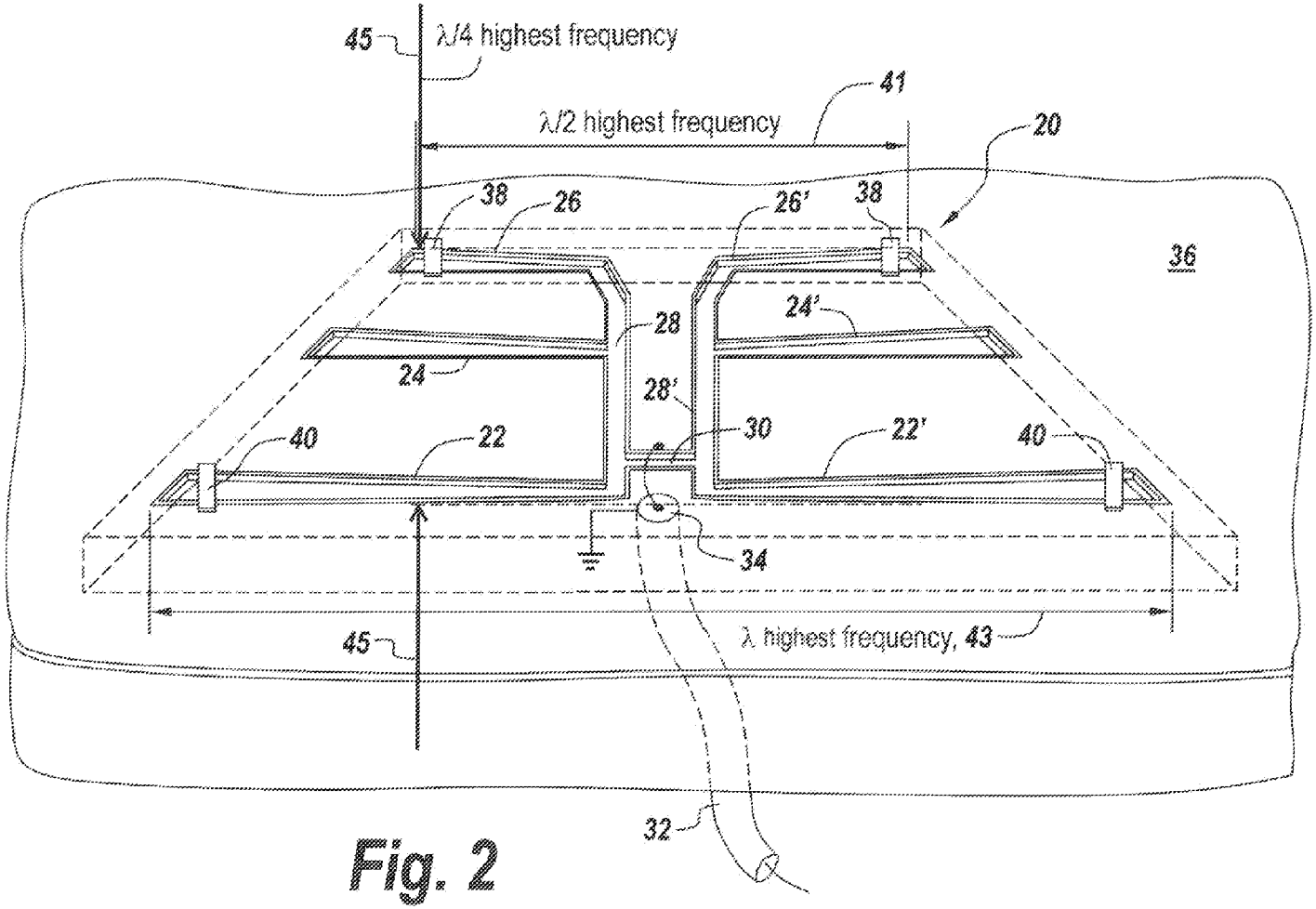
FIG. 2 is a diagrammatic illustration of a multi-arm slot antenna.

Referring now to FIG. 2, in order for the provision of a slot antenna of for instance a 2:1 bandwidth, the slot antenna of FIG. 1 is converted into a multi-armed slot antenna in which antenna 20 is composed of a ground plane with connecting slits, with the slits forming multiple arms all fitting within a trapezoidal envelope afforded by the decreasing length of the slits in the illustrated embodiment.

As illustrated, the longest arms 22 and 22' have an overall length 43 of one wavelength at the highest frequency. Alternatively, for a 2:1 bandwidth, the overall length of the longest arms can be set to one-half wavelength at the lowest frequency of operation. Intermediate arms 24 and 24' are shorter than arms 22 and 22' corresponding to an intermediate frequency. In order to accommodate the highest frequency, arms 26 and 26' are shortened such that their overall length 41 corresponds to a half the wavelength at the highest frequency.

It will be seen that all of the arms are connected together by backbone slits 28 and 28', with a feedpoint 30 being in the form of a slit that runs between slits 28 and 28'. It is this feedpoint slit that is driven diagrammatically by a coaxial cable 32 which has its center conductor 34 coupled to one side of slit 30 and with its exterior shield grounded to the ground plane, here illustrated at 36.

What will be appreciated from viewing antenna 20 is that the cavity-backed slot antenna is formed within a ground plane by slits 22, 22'; 24, 24'; and 26, 26'. These slits are interconnected by slits 28, 28' and 30. Moreover, it will be appreciated that the slits that form the arms may be tapered wider towards the ends of the arms to provide for better input impedance versus frequency.

Importantly, the width of the antenna from short slits to long slits is shown by arrow 45 which must be kept under $\lambda/4$ at the highest frequency. This is a critical dimension over which the antenna ceases to operate effectively, due to higher-order modes.

The antenna shown in FIG. 2 is capable of providing a 2:1 bandwidth for a receiver or transmitter. However, by adding magnetic loading strips 38 to the distal ends of the shorter arms and resistive loading strips 40 at the distal ends of the longer arms, a 3:1 bandwidth is achievable with this multi-arm structure, assisted by the addition of a customized balun, which may feed the slot from within the cavity below it.

Note also that the bandwidth is increased markedly over the slot antenna of FIG. 1 without having to utilize fat slots or open-ended waveguide that increase the structural radar cross section.

Figure 3:
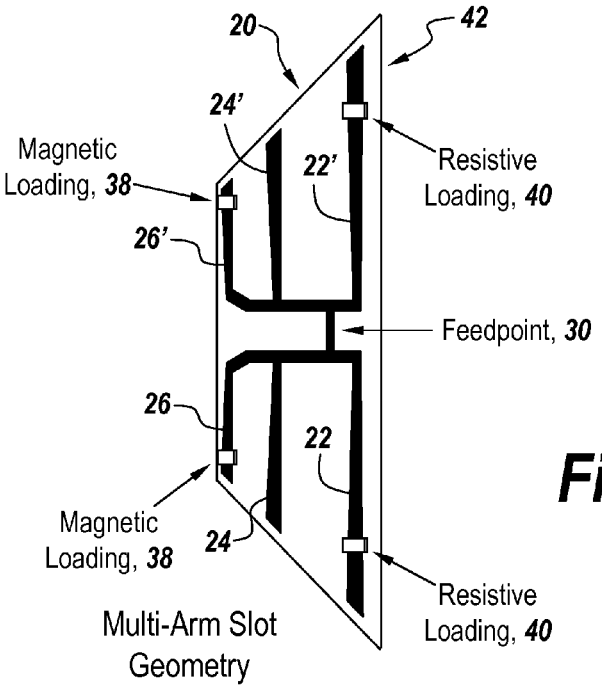
FIG. 3 is a more stylized diagram of the multi-arm slot antenna of FIG. 2.

The antenna of FIG. 2 is shown diagrammatically in FIG. 3 oriented in a vertical plane 32 which is typically located on the side of an aircraft on the skin thereof and when arrayed can provide the equivalent of a monopole antenna extending outwardly from plane 32, with the arms indicated by the associated reference characters.

Figure 4:
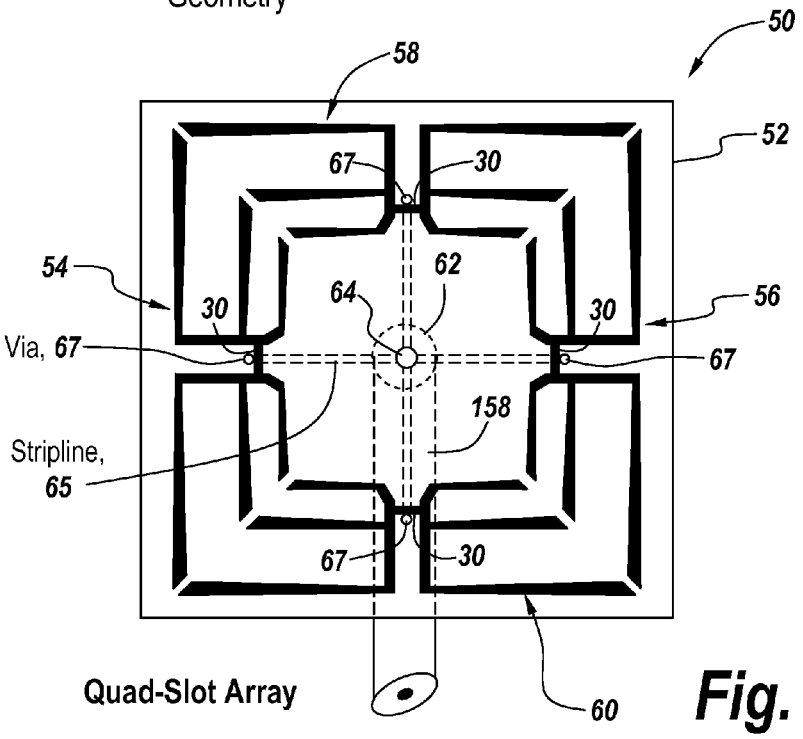
FIG. 4 is a diagrammatic illustration of a quad slot array utilizing four of the multi-arm slot antennas of FIG. 2.

In order to provide for the aforementioned monopole performance, in one embodiment a quad slot array 50 is shown in FIG. 4 in which four multi-arm slot antennas of the type described in FIG. 2 are set into ground plane 52, with feedpoints 30 opposed as illustrated. The result is a quad arrangement of four cavity backed slot antennas that fit into a square. The first antenna shown here at 54 is opposed to antenna 56, with antenna 58 opposed to antenna 60. For convenience the coaxial cable 62 feed may come to the center of the array where its outer shield is connected to the ground plane 52. The center conductor 64 is connected in parallel to the feedpoints 30 in parallel using strip lines 65 which run under the ground plane and are connected to respective feedpoints 30 using vias 67.

It will be seen that antennas 54-60 are contained within a square area 52 such that the length across any square dimension is equal to or less than one-half wavelength at the lowest frequency at which the antenna is to operate.

Referring again to FIG. 2, one embodiment of a multi-arm slot geometry is shown. This geometry utilizes three slit radiators with end-loading applied to extend the basic frequency range lower to achieve a nominal 3:1 bandwidth. Thus the geometry can be selected such that the radiating portion is no more than half-wavelength for good radiation efficiency. The element loading may be incorporated across the longest and shortest arms prevents higher order modes that would be present otherwise in the extended frequency range. The higher order modes can cause poor radiation efficiency within a 3:1 bandwidth and distort the nominal cosine pattern impacting the broadband gain and phase, and thus increasing DF error. However, 2:1 bandwidth may be achieved without loading. In the embodiment shown in FIG. 2, the shortest arms are magnetically loaded, while the longest arms are resistively loaded.

FIG. 4 shows one embodiment of a quad-slot array configuration, with four of the multi-arm slot antennas of FIG. 2 oriented at 90 degrees relative to each other. This particular configuration yields a monopole pattern and polarization when all elements are fed in phase. In this particular embodiment, the shorter arms are spaced at a half wavelength at the maximum frequency and the longer arms are spaced a distance less than or equal to a half wavelength at the minimum frequency. The antenna is designed such that the phase center moves toward the shorter arms with increased frequency so that electrical spacing of half-wavelength or less can be maintained over a 3:1 bandwidth. Such a design can be used for low complexity arctangent DF applications. Arraying the geometry in a quad configuration allows for a 3-channel DF compatibility. This configuration also results in effectively using a half-wavelength slot which has high-efficiency while maintaining an acceptable cosine pattern required for arctangent DF.

Figure 5:
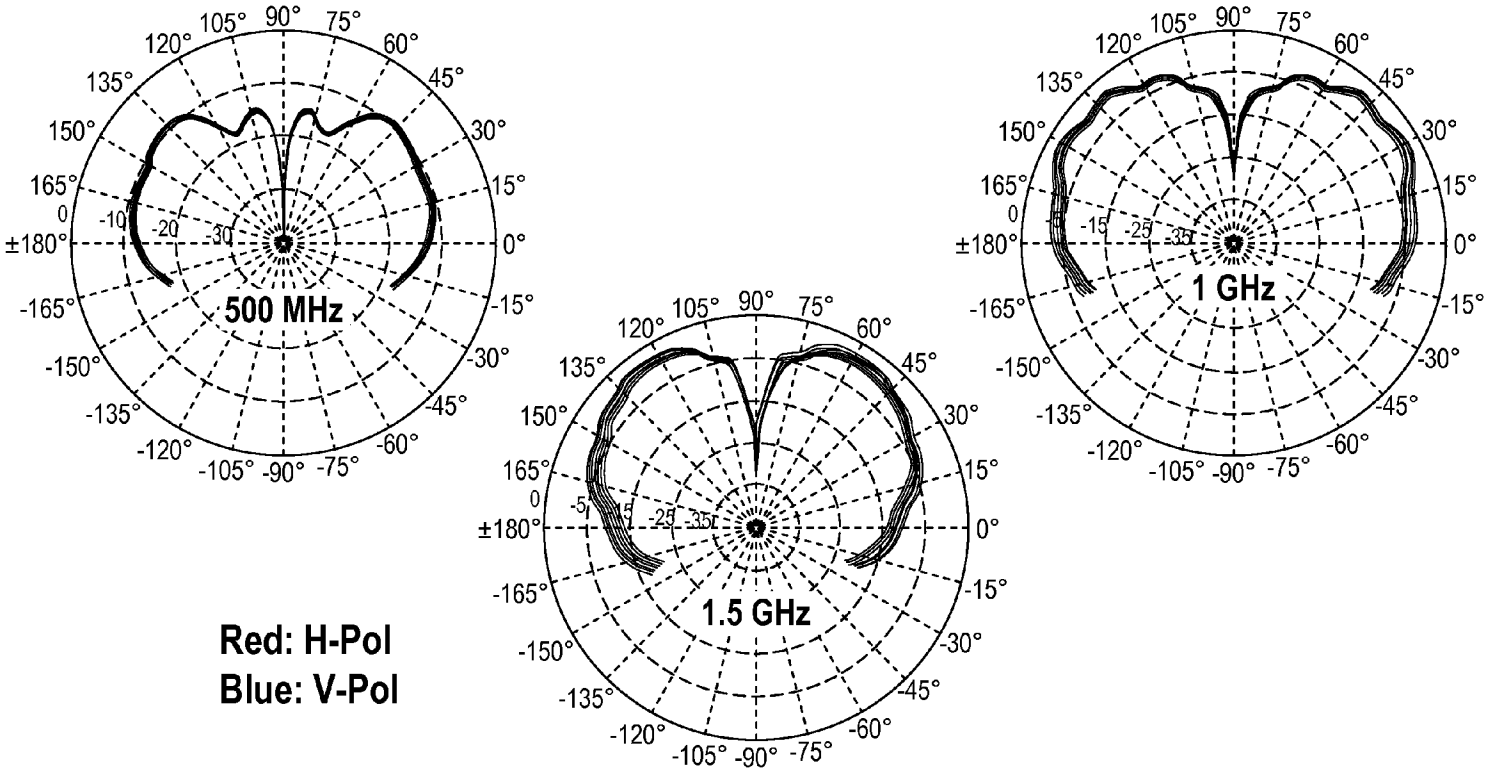
FIG. 5 is a series of graphs showing the elevation patterns of an L-band quad-slot array.
Figure 6:
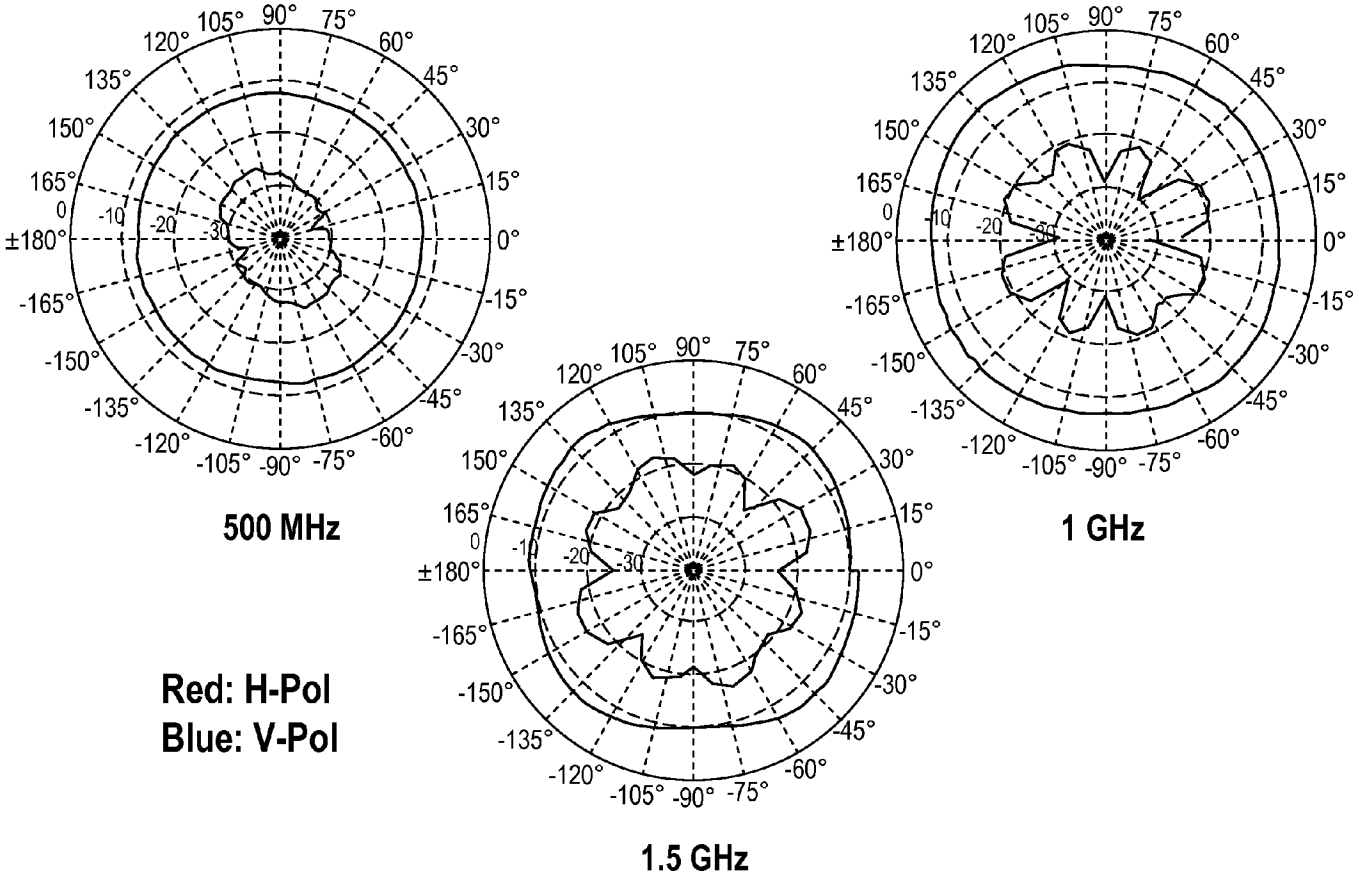
FIG. 6 is a series of graphs showing the azimuth patterns of an L-band quad-slot array.

Referring to FIGS. 5 and 6, the elevation and azimuth patterns for an L-band multi-arm slot are shown respectively. These monopole radiation patterns are produced by the quad-slot array when all elements are fed in-phase. The weaker patterns of FIG. 6 are cross-polarized.

Figure 7:
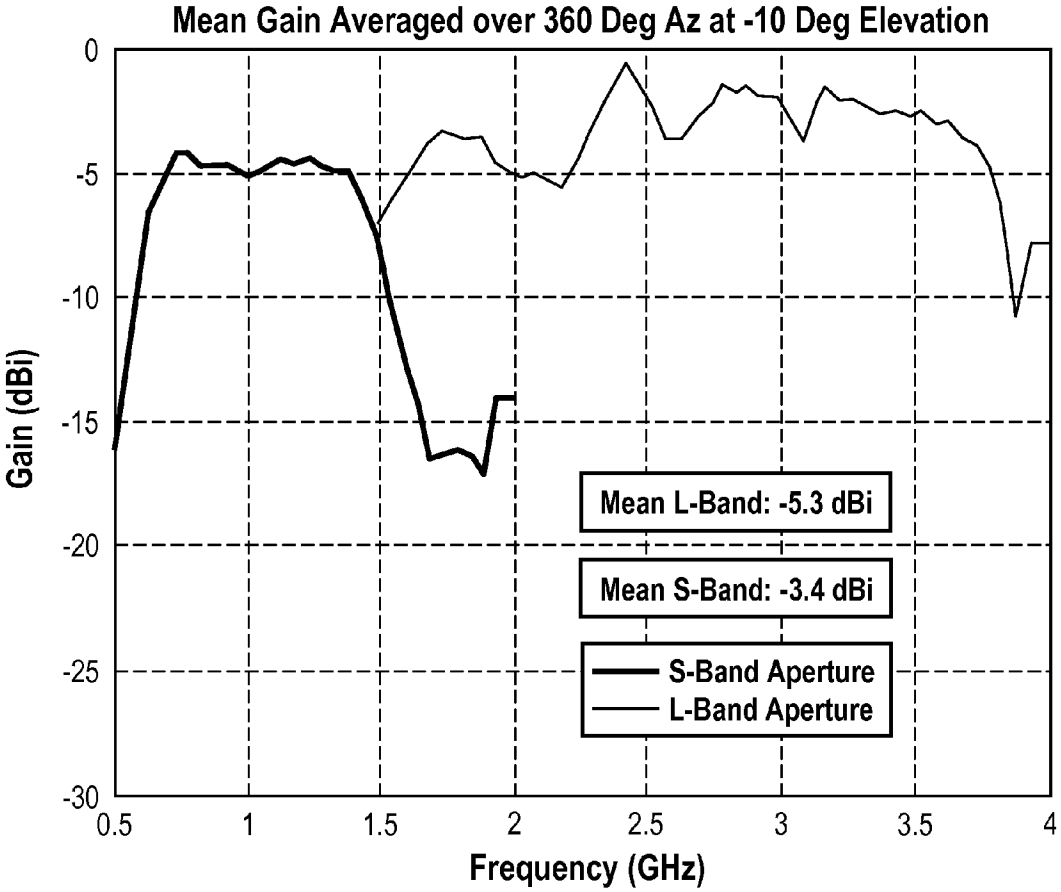
FIG. 7 is a graph of the mean L-band and S-band quad-slot swept gain.

Referring now to FIG. 7, the mean swept gain over 360 degrees azimuth, at θ=80 (10 degrees above the horizon) is shown. This mean swept gain is for an L-band and S-band multi-arm quad-slot aperture, demonstrating the gain response. In one embodiment, utilizing 50 W-capable terminations within the longest arms, one S-band multi-arm element was successfully tested to 50 W Average/100 W Peak. Thus the quad aperture is capable of 200 W Avg/400 W Peak.

Figure 8:
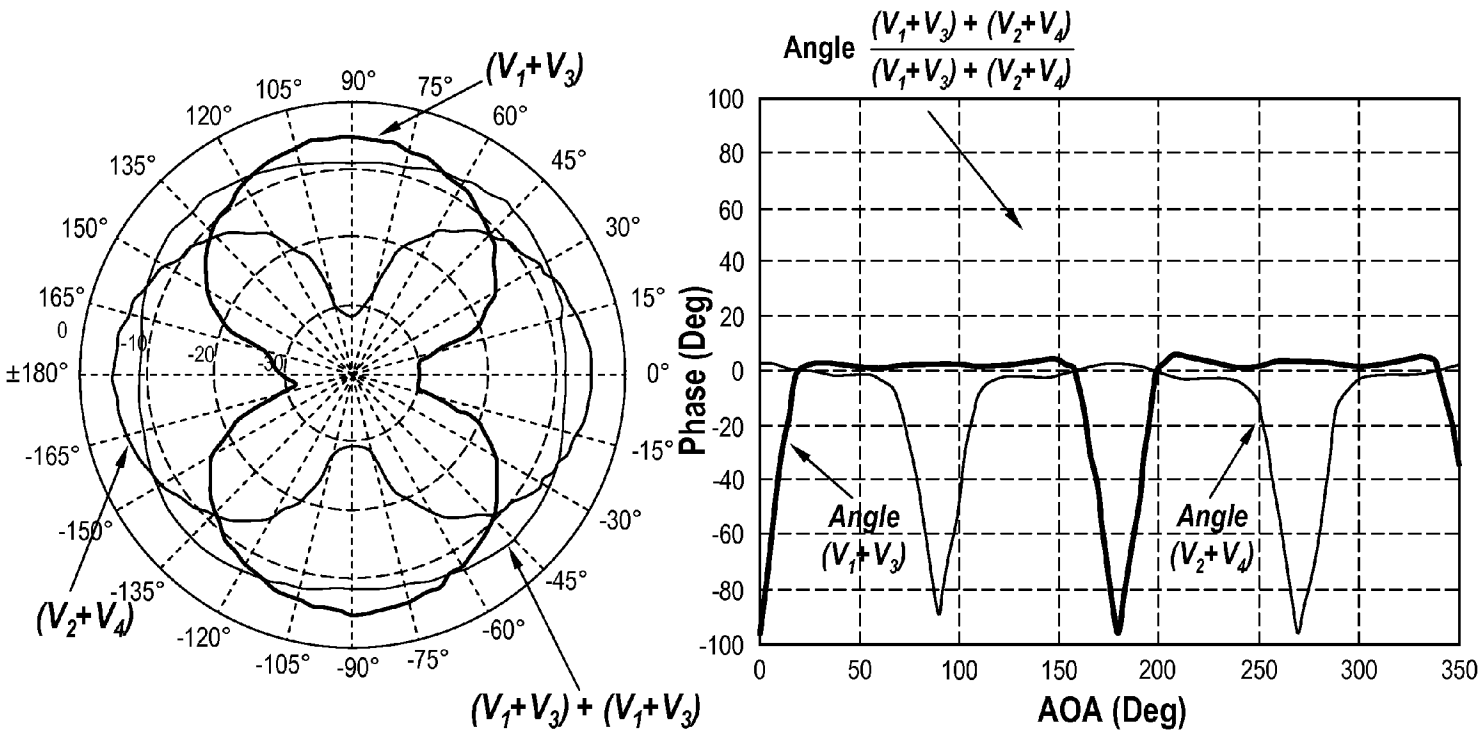
FIG. 8 is a series of graphs showing Phase vs. AOA for a L-band quad-slot aperture at 1 GHz.

Referring to FIG. 8, the vertical polarization, V-pol, azimuth angle-of-arrival can be found, with a 90 degree ambiguity, using a simple Arctangent algorithm by computing:

$$\phi = \arctan\left|\frac{(v_1 + v_3) + i(v_2 + v_4)}{(v_1 + v_3) + (v_2 + v_4)}\right|$$

Where $v_n$ stands for the complex antenna voltages received at each feedpoint of the quad array.

If the elements are ideal cosine patterns, this yields AOA vs. ϕ with a Sin(2ϕ) function. Practically, there is pattern distortion which can be calibrated using a simple look-up table. The measured element and sum patterns and their phase response vs. AOA for the L-Band quad slot antenna at 1 GHz are shown in FIG. 6.

Figure 9:
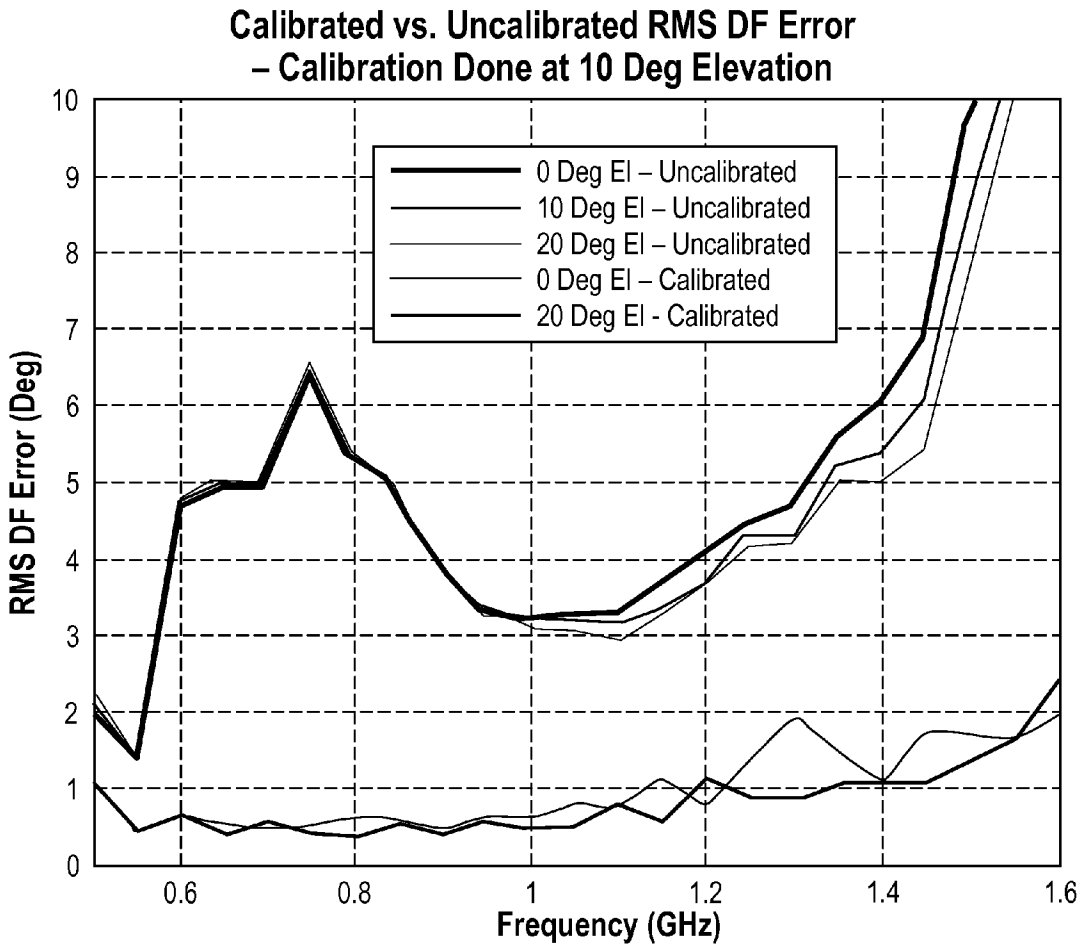
FIG. 9 is a graph of the calibrated and uncalibrated AOA error of an L-band quad-slot array.

Referring to FIG. 9, the calibrated and uncalibrated AOA error is shown at 0, 10, and 20 degrees elevation using 10 degree elevation data as the calibration data. This graph demonstrates both a 3:1 DF bandwidth and minimal sensitivity to calibration in elevation for near grazing angle incidence.

Figure 10:
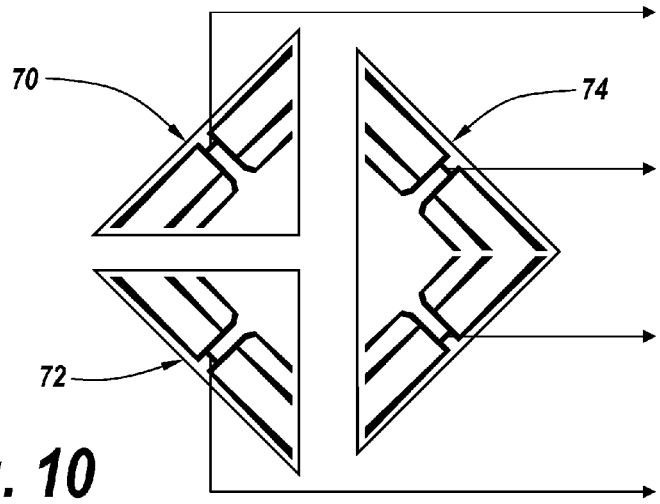
FIG. 10 is a diagrammatic representation of one possible configurations of a multi-arm slot array.

Many different configurations of the multi-arm conformal slot antenna are possible. Referring to FIG. 10, one possible configuration is shown. Here two of the multi-arm conformal slot antennas of Figure N are skewed or canted on their own separate ground planes as illustrated by antennas 70 and 72. These face a pair of oppositely skewed antennas 74 on their own ground plane. The antennas are fed in parallel as illustrated.

Figure 11:
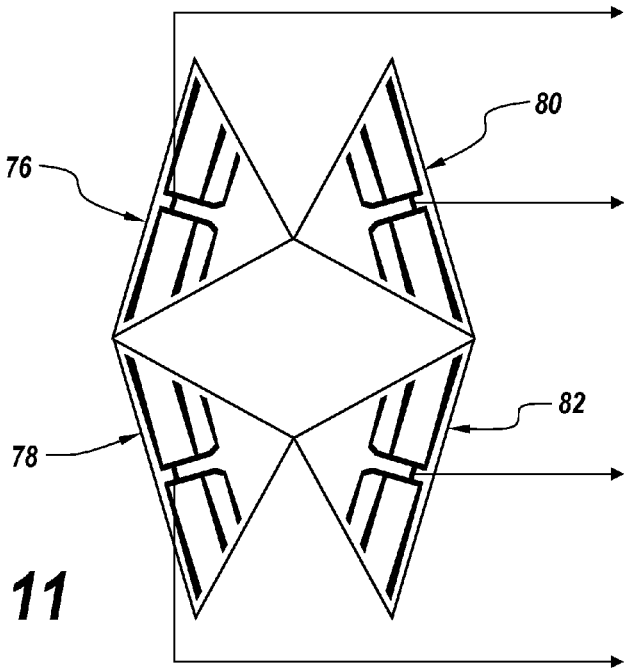
FIG. 11 is a diagrammatic representation of another possible configuration of a multi-arm slot array.

Referring to FIG. 11 another configuration shows slot antennas 76-82 skewed with respect to each other and fed in parallel.

Figure 12:
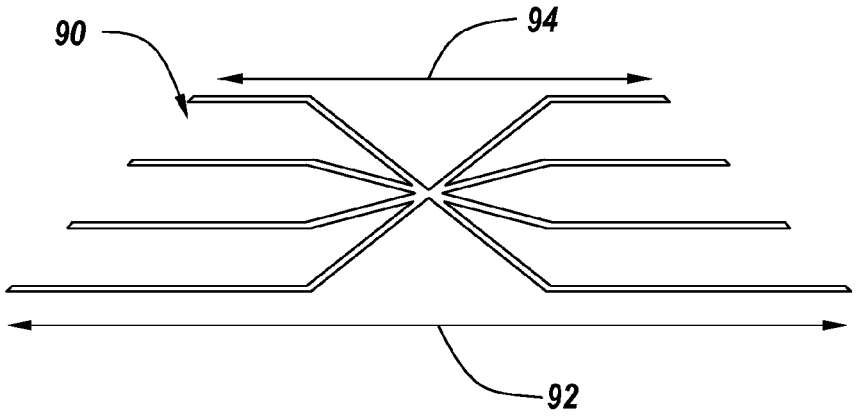
FIG. 12 is a diagrammatic representation of a spider-like arrangement for the slits of the cavity-backed slot antenna.

Referring to FIG. 12, rather than using the pitchfork configuration for the arms previously illustrated, a spider pattern 90 for the slits may be used, revealing design flexibility within the trapezoidal envelope. Here a 2:1 bandwidth is achievable with the length 92 of the long side being twice that of the short side 94.

Figure 13:
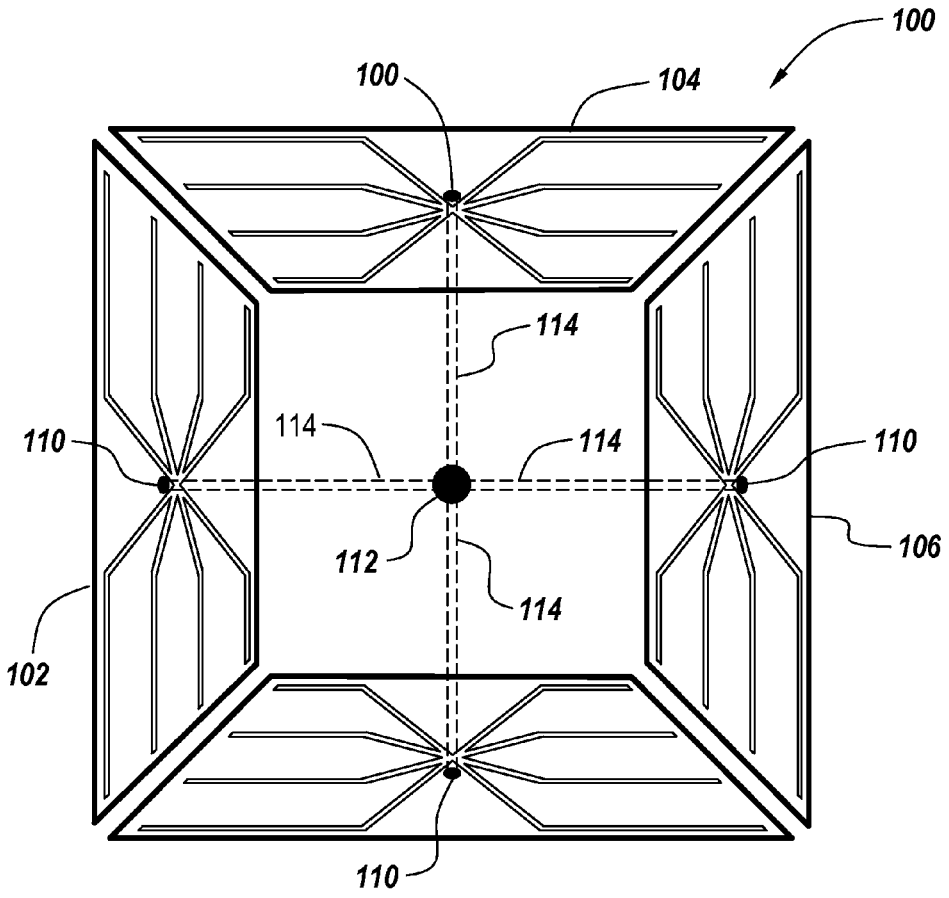
FIG. 13 is a diagrammatic representation of a quad arrangement for the spider antenna embodiment of FIG. 12 showing a common feedpoint of the antenna elements.

Referring to FIG. 13, a quad array 100 of spider cavity-backed slot antennas 102-108 is shown. These pairs of spider antennas are shown opposed, with the feedpoints 110 fed from the center conductor 112 of the coaxial feed as shown by strip lines 114.

Figure 14:
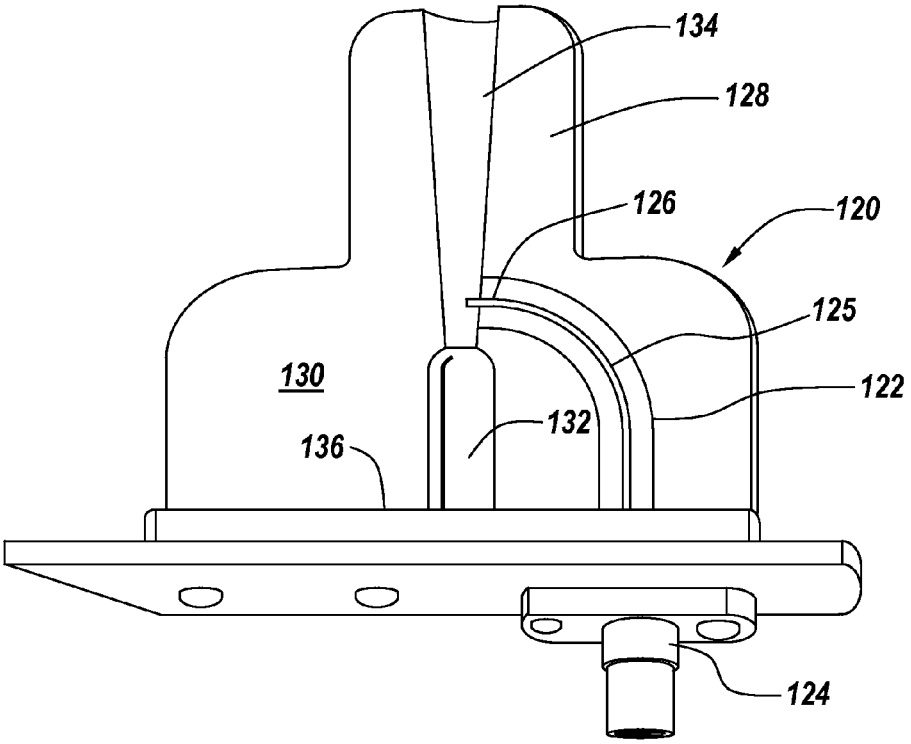
FIG. 14 is a diagrammatic illustration of a balun for use in feeding the conformal multi-arm slot antenna of FIG. 2.

For the slot embodiment of FIG. 2, improved bandwidth is accomplished through applying a slot line balun feed to the multi-arm conformal antenna and optimizing slot geometry. Referring now to FIG. 14, an ultra-wideband balun 120 is shown having an extension 122 from a 50 ohm coaxial input transmission line 124. The center conductor of the coaxial cable 125 extends up through extension 122 to a junction 126 between balanced and unbalanced transmission lines.

This junction is located in a dielectric substrate 128 with a stripline on the inside (not shown) and a metallic slab or plating 130 on the outside of the substrate.

At junction 126 wire lead 125 connects to the center strip of the stripline at which an open-circuited quarter-wave stripline stub exists that is connected in series with a short circuited transmission line 132 and a tapered balanced transmission line 134 of balun 120. It is noted that short circuited transmission line 132 comprises two slabs extending from junction 126 down to a metal end wall 136 with dielectric material removed from the gap. Short circuited transmission line 132 presents a high impedance as connected in parallel to tapered balanced transmission line 134, causing greater signal power to flow on the tapered slotline 134. It is noted that transmission line 134 leads up to a connection point that gets affixed to the feedpoint of the slot which is on a separate stripline board perpendicular to this balun. The tapered slot balanced transmission line 134 smoothly transfers the characteristic impedance from a nominal 100 ohms to approximately 200 ohms.

It is noted that the impedance of the slot feedpoint is nominal and actually varies with frequency. The off-center frequency reactance of the balun is designed to match that of the slot at the extremes of the 3:1 band. As a result balun 120 serves to provide an ultra-wideband impedance matching element for the subject antennas.

While the present invention is described in connection with preferred embodiments, it is to be understood that other similar embodiments may be used or modifications and additions may be made to the described embodiments for performing the same function of the present invention without deviating therefrom. Therefore, the present invention should not be limited to any single embodiment.

What is claimed is:

1. A low radiation cross section wide bandwidth conformal cavity-backed slot antenna having a wide 2:1 instantaneous bandwidth, comprising:

a cavity-backed multi-arm slot antenna having a single cavity in back of a ground plane, a single central feedpoint and a number of different length directly driven pairs of spaced apart opposed slits in said ground plane, each pair of opposed slits forming an actively driven dipole, said opposed spaced apart slits being free ended at the distal ends thereof, outwardly width-wise tapered, wide and connected across proximal slit ends to said single central feed point that forms a center feed for the associated dipole, said slits comprising pairs of opposed unfolded arms characterized by short slits and long slits, the distal ends of said short slits and said long slits defining a trapezoidal envelope, the shortest distance between said short slits and said long slits being no more than one-quarter wavelength at the highest frequency at which said antenna is to operate, the overall length of said long slits being twice that of the overall length of said short slits, such that said wide 2:1 instantaneous bandwidth with low radiation cross section for a cavity-backed antenna is obtained by said tapering, said wide slits and said dimensions.

2. The antenna of claim 1, wherein said trapezoidal envelope induces the phase-center of said multi-arm slot antenna to shift with frequency.

3. The antenna of claim 1, wherein the sides of said trapezoidal envelope are at 45 degree angles with respect to the base thereof.

4. The antenna of claim 1, wherein said antenna includes three pairs of slits, each pair of slits electrically coupled together by a backbone slit such that each half of said antenna resembles a pitchfork.

5. The antenna of claim 4, wherein said backbones are in spaced adjacency, with the slits associated with one pair pointing in an opposite direction to those of the other pair.

6. The antenna of claim 5, and further including a slit serving as a feedpoint between said two opposed backbones.

7. The antenna of claim 1, and further including magnetic loading at the distal ends of said short slits and resistance loading at the distal ends of said long slits, thereby to improve the low frequency bandwidth of said antenna.

8. The antenna of claim 1, and further including an ultra-wide band balun coupled to said single central feedpoint.

9. The antenna of claim 1, wherein said slits are tapered outwardly from proximal end to distal end for improving the bandwidth of said antenna.

10. The antenna of claim 1, wherein the pattern of said slits resembles a pitchfork.

11. The antenna of claim 1, wherein the pattern of said slits resembles a spider pattern.

12. The antenna of claim 1, and further including a pair of said multi-arm slot antennas arrayed in back-to-back fashion, with said single central feedpoint serving as a common feedpoint.

13. The antenna of claim 12, and further including a second pair of said multi-arm slot antennas arrayed back-to-back and oriented orthogonally to said first-mentioned back-to-back pair of antennas to form a quad array.

14. The antenna of claim 12, wherein said pair of multi-arm slot antennas are arrayed with a spacing therebetween that results in the phase-center associated with one back-to-back antenna being spaced from the phase-center associated with the other back-to-back antenna being within one-half a wavelength for all frequencies at which said antenna is to operate.

15. The antenna of claim 1, and further including four of said multi-armed slot antennas arrayed in a square configuration.

16. The antenna of claim 15, wherein said antennas in a square configuration are arrayed without exceeding a one-half wavelength array spacing for the phase-centers of said antennas.

17. A stealth octave bandwidth conformal cavity-backed slot antenna having a low radiation cross section, comprising:

a number of different length free-ended unfolded slits in a ground plane in which the distal ends of said slits are free ended, with pairs of said slits in horizontal spaced adjacency forming a dipole, wherein said slits have proximal and distal ends, said slits backed with a single cavity with said slits having a common feedpoint across the proximal ends thereof, and wherein said slits are directly driven and outwardly widthwise tapered from the proximal ends thereof to the distal ends thereof for purposes of improving the bandwidth of said cavity-backed slot antenna, wherein each side of said antenna includes a pair of unfolded in-line short slits, a pair of unfolded in-line medium size slits and a pair of unfolded in-line long slits. wherein the overall length of said in-line short slits is equal to one-half wavelength at the highest frequency at which said antenna is to operate, and wherein the overall length of said in-line long slits is equal to one wavelength at the highest frequency at which said antenna is to operate.

18. The antenna of claim 17, wherein said antenna is divided into two sides, each side having at least three slits going from the feedpoint thereof outwardly to the distal ends thereof, said sides connected by a feedpoint slit.

19. The antenna of claim 18, wherein the multiple slits for each side of said antenna are connected together through a central backbone slit such that each side of said antenna resembles a pitchfork.

20. The antenna of claim 17, wherein the tips of said slits define a trapezoidal envelope, with the sides of said trapezoidal forming a 45 degree angle at the base thereof.

21. The antenna of claim 17, wherein the width of the antenna as measured by the shortest distance between said short slits and said long slits is no more than one-quarter wavelength at the highest frequency at which said antenna is to operate.

* * * * *